US005483429A

United States Patent [19]

Chu

[11] Patent Number: 5,483,429

[45] Date of Patent: Jan. 9, 1996

[54] PEN/HAND TORCH COMBINATION DEVICE

[76] Inventor: An G. Chu, P.O. Box 82-144, Taipei City, Taiwan

[21] Appl. No.: 397,965

[22] Filed: Mar. 3, 1995

[51] Int. Cl.[6] ..... B43K 29/10

[52] U.S. Cl. ..... 362/118; 362/207; 401/195

[58] Field of Search ..... 362/118, 109, 362/157, 202, 204, 205, 207, 208, 120, 253; 401/195

[56] References Cited

U.S. PATENT DOCUMENTS

| | | | |
|---|---|---|---|
| 3,333,095 | 7/1967 | Muess | 362/118 |
| 4,028,540 | 6/1977 | Key, Jr. et al. | 362/118 |
| 4,890,204 | 12/1989 | Lin et al. | 362/118 |
| 4,964,024 | 10/1990 | Tsay | 362/118 |
| 5,143,465 | 9/1992 | Hou | 362/118 X |
| 5,275,497 | 1/1994 | Shiau | 362/118 X |
| 5,405,208 | 4/1995 | Hsich | 362/118 X |
| 5,413,429 | 5/1995 | Shiau | 362/118 X |

*Primary Examiner*—Ira S. Lazarus
*Assistant Examiner*—Thomas M. Sember
*Attorney, Agent, or Firm*—Alfred Lei

[57] ABSTRACT

A pen/hand torch combination device having a metal cylinder mounted on the pen holder to hold a battery, a holder mounted one end of the metal cylinder to hold a lamp socket with a lamp bulb, an insulator mounted between the cylinder and the holder to hold a pen clip, and a top socket mounted on the holder to hold a reflector above the lamp bulb, wherein when the pen clip is depressed to contact the cylinder, the battery is electrically connected to the lamp socket, causing the lamp bulb turned on; when the pen clip is released from the metal cylinder, the lamp bulb is turned off.

1 Claim, 4 Drawing Sheets

PEN/HAND TORCH COMBINATION DEVICE

BACKGROUND OF THE INVENTION

The present invention relates a pen/hand torch combination device which combines a pen with a hand torch and is operated to give off light by means of controlling the pen clip.

Regular hand torches are commonly designed for illumination only. These hand torches are commonly big and not convenient for carrying on one's clothes. When not in use, consumers tend to put the hand torches in drawers, cabinets, or anywhere in the house. When one wishes to use the hand torch, one may have to spend a lot of time in finding it out.

SUMMARY OF THE INVENTION

It is one object of the present invention to provide a pen/hand torch combination device which can be used as a pen as well as a hand torch. It is another object of the present invention to provide a pen/hand torch combination device which is compact and can be conveniently carried on the clothes. It is still another object of the present invention to provide a pen/hand torch combination device which can be conveniently operated to turn on the lamp bulb by depressing the pen clip.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
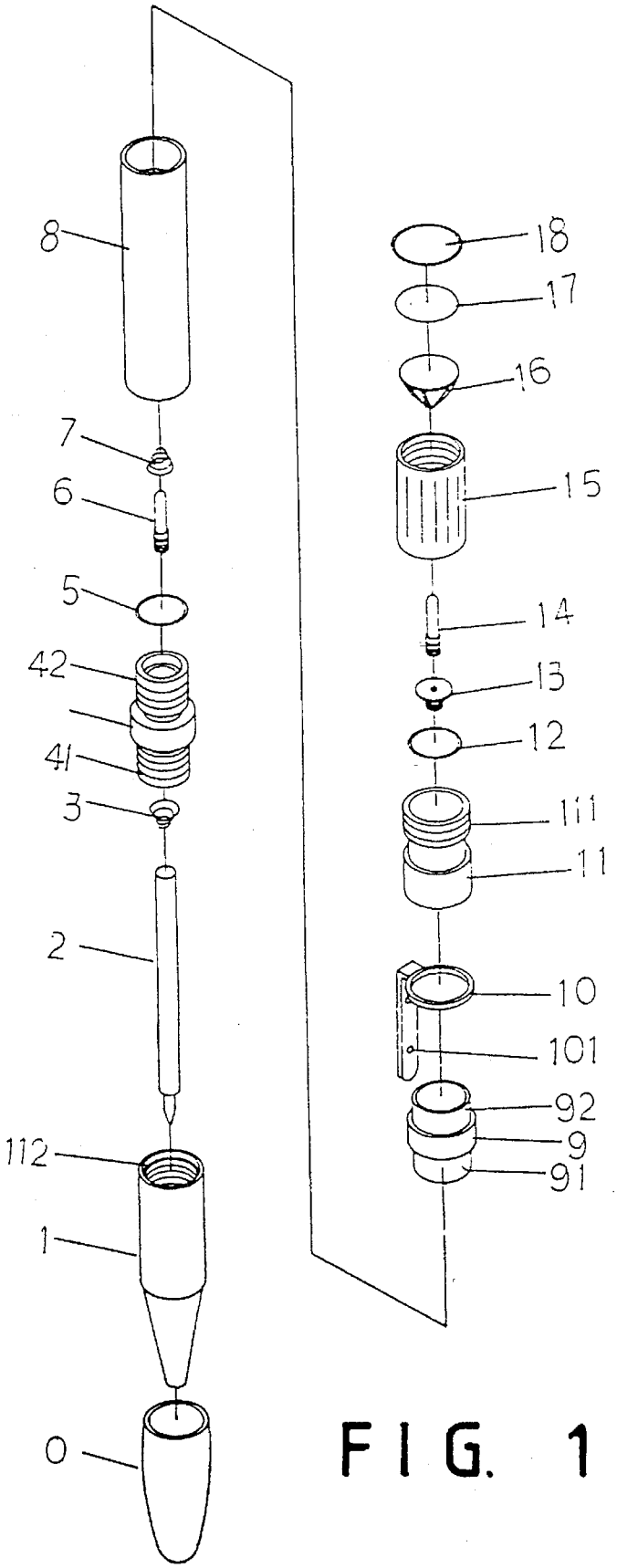
FIG. 1 is an exploded view of a pen/hand torch combination device according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
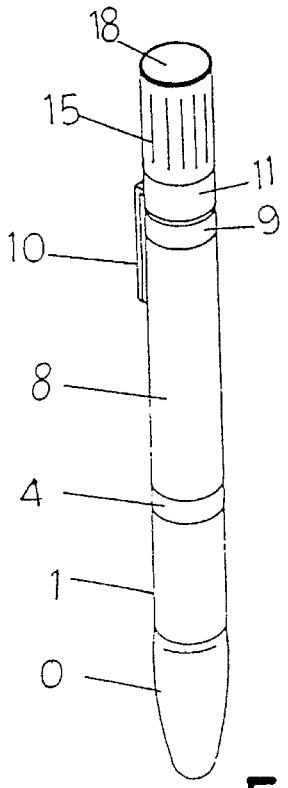
FIG. 2 is an elevational view of the pen/hand torch combination device shown in FIG. 1.

Referring to FIGS. 1 and 2, a pen/hand torch combination device in accordance with the present invention is generally comprised of a pen cap O, a pen holder 1, a refill 2, a first spring 3, a refill holder 4, a first O-ring 5, a first bulb 6, a second spring 7, a metal cylinder 8, an insulator 9, a pen clip 10, a holder 11, a second O-ring 12, a lamp socket 13, a second bulb 14, a top socket 15, a reflector 16, a third O-ring 17, and a glass 18. The pen cap O is covered on the tapered front end of the pen holder 1. The rear end of the pen holder 1 is made with an inner thread 112. The refill holder 4 has a first outer thread 41 and a second outer thread 42 at two opposite ends. The first outer thread 41 of the refill holder 4 is threaded into the inner thread 112 of the pen holder 1 to hold the first spring 3 and the refill 2. The first spring 3 is received inside the refill holder 4 and stopped against the refill 2. The refill 2 is received inside the pen holder 1, having one end stopped against the first spring 3 and an opposite end extended out of the tapered front end of the pen holder 1. The first O-ring 5 is mounted around the second outer thread 42 of the refill holder 4. The first bulb 6 is received ill a chamber (not shown) inside the refill holder 4 as a spare bulb. A second spring 7 is mounted in the refill holder 4 above the first bulb 6 to support one end of the battery. The metal cylinder 8 has a bottom end threaded onto the second outer thread 42 of the refill holder 4 and a top end sleeved onto the bottom end 91 of the insulator 9. The insulator 9 has a top end 92 fitted into the holder 11. The pen clip 10 is mounted around the top end 92 of the insulator 9 and retained between the insulator 9 and the holder 11, having a contact 101 at an inner side disposed in contact with the metal cylinder 8. The holder 11 has an outer thread 111 threaded into an inner thread (not shown) on the top socket 15. The second O-ring 12 is mounted around the holder 11. The lamp socket 13 is mounted inside the holder 11 to to the second bulb 14. The reflector 16 is mounted inside the top socket 15 and then sealed by the third O-ring 17 and covered by the glass 18.

Figure 3:
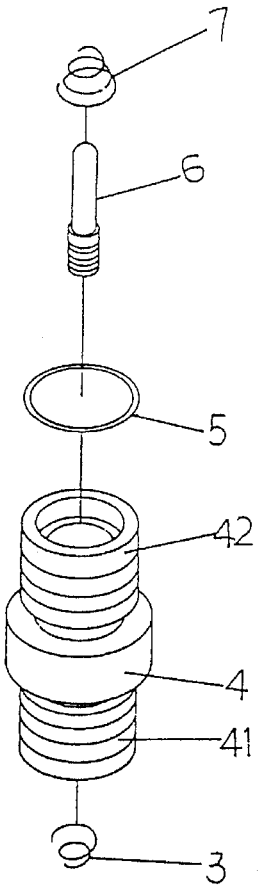
FIG. 3 is an exploded view in an enlarged scale of the refill holder, second spring, first O-ring, spare bulb, and second spring of the pen/hand torch combination device shown in FIG. 1.
Figure 4:
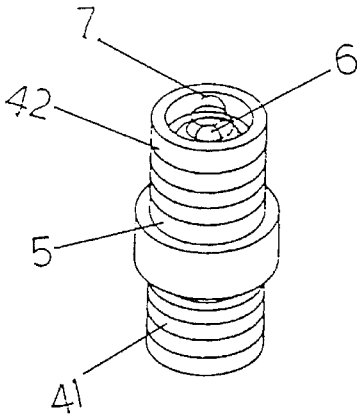
FIG. 4 is an assembly view of FIG. 3.

Referring to FIGS. 3 and 4, the refill holder 4 has a first outer thread 41 and a second outer thread 42 at two opposite ends; the first spring 3 is received inside the refill holder 4 at the bottom; the first O-ring 5 is mounted around the second outer thread 42 of the refill holder 4; the first bulb (the spare bulb) 6 is received inside the refill holder 4 at the top; the second spring 7 is mounted on the first bulb 6 inside the refill holder 4.

Figure 5:
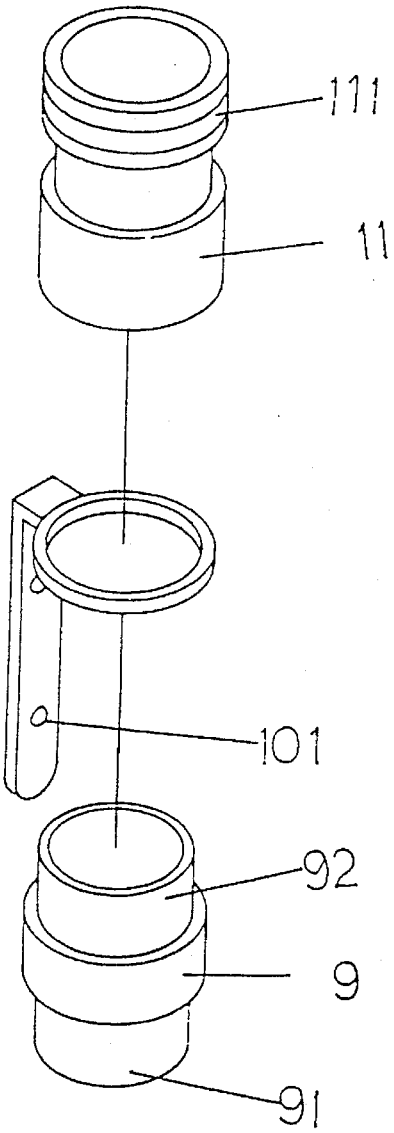
FIG. 5 is an exploded view in an enlarged scale of the insulator, pen clip and holder of the pen/hand torch combination device shown in FIG. 1.
Figure 6:
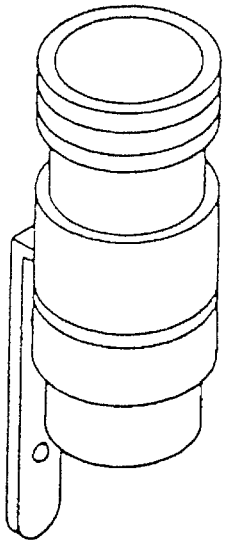
FIG. 6 is an assembly view of FIG. 5.

Referring to FIGS. 5 and 6, the holder 11 is sleeved onto the top end 92 of the insulator 9, and the pen cap 10 is mounted around the top end 92 of the insulator 9 and retained in place by the holder 11.

Figure 7:
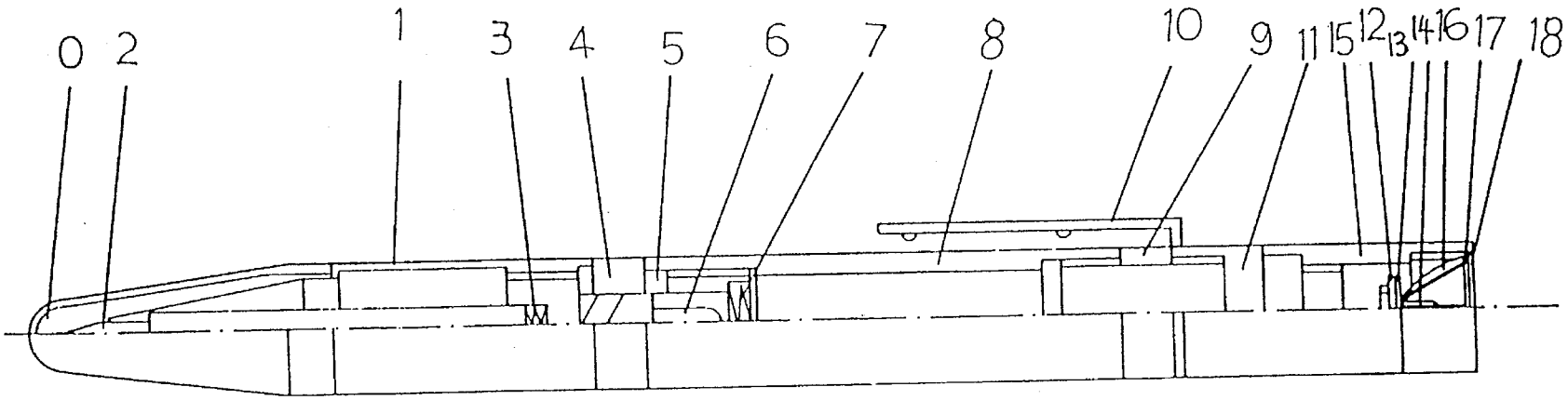
FIG. 7 is a longitudinal view in section of the pen/hand torch combination device shown in FIG. 2.

Referring to FIG. 7, when the pen cap 0 is removed from the pen holder 1, the writing tip of the refill 2 is exposed to the outside for writing. When the pen holder 1 is disconnected from the first outer thread 41 of the refill holder 4, the refill 2 can then be replaced. The battery is mounted inside the insulator 9 within the cylinder 8 and electrically connected to the second bulb 14 by means of the control of the pen clip 10. When the contact 101 of the pen clip 10 is forced to contact the metal cylinder 8, the second bulb 14 is turned on. On the contrary, when the pen clip 10 is released from the hand, the contact 101 is disconnected from the metal cylinder 8, and therefore the second bulb 14 is turned off. When the cylinder 8 is disconnected from the second outer thread 42 of the refill holder 4 and the top socket 15 is disconnected from the holder 11, the battery can be replaced. By means of the pen clip 10, the pen/hand torch combination device can be carried on the pocket or the like.

It is to be understood that the drawings are designed for purposes of illustration only, and are not intended as a definition of the limits and scope of the invention disclosed.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A pen/hand torch combination device comprising:

a pen holder having a tapered front end detachably covered with a pen cap, and a rear end made with an inner thread;

a refill inserted into said pen holder and having a writing tip extended out of the tapered front end of said pen holder;

a refill holder having a first outer thread at one end threaded into the inner thread on said pen holder, a second outer thread at an opposite side, and an inside chamber for holding a spare lamp bulb;

a first spring mounted inside said refill holder and stopped against said refill to hold said refill in said pen holder;

a first O-ring mounted around the second outer thread of said refill holder;

a second spring mounted within said refill holder;

a metal cylinder having an inner thread at one end threaded onto the second outer thread of said refill holder;

an insulator having a bottom end fitted into another end of said cylinder remote from said refill holder, and a top end;

a pen clip mounted around the top end of said insulator and having a contact spaced from said metal cylinder;

a holder having a bottom end sleeved onto the top end of said insulator to hold said pen clip in position, and a top end made with an outer thread;

a battery mounted inside said insulator within said cylinder and supported on said second spring;

a lamp socket mounted inside said holder and stopped against said battery opposite to said second spring to hold a lamp bulb;

a top socket threaded onto the outer thread of said holder;

a reflector mounted Within said top socket and sealed by an O-ring and covered by a glass; and wherein said pen clip is depressed to force said contact into contact with said metal cylinder, the lamp bulb of said lamp socket is turned on to give off light through said reflector; and when said pen clip is released from depression to disconnect said contact from said metal cylinder, the lamp bulb of said lamp socket is turned off.

* * * * *